US005544875A

United States Patent [19]

Obara

[11] Patent Number: 5,544,875

[45] Date of Patent: Aug. 13, 1996

[54] PAPER STACKING APPARATUS

[75] Inventor: Noriyuki Obara, Ebina, Japan

[73] Assignee: Fuji Xerox Co., Ltd., Tokyo, Japan

[21] Appl. No.: 321,515

[22] Filed: Oct. 12, 1994

[30] Foreign Application Priority Data

Jan. 17, 1994 [JP] Japan ..... 6-016986

[51] Int. Cl.[6] ..... B65H 43/00

[52] U.S. Cl. ..... 271/176; 271/215; 271/315

[58] Field of Search ..... 271/176, 207, 271/213, 215, 217, 223, 315

[56] References Cited

U.S. PATENT DOCUMENTS 5,033,731 7/1991 Looney ..... 271/176

FOREIGN PATENT DOCUMENTS 61-37664 2/1986 Japan ..... 271/215
1-198766 8/1989 Japan .
2-69665 5/1990 Japan .
4-251070 9/1992 Japan .

*Primary Examiner*—David H. Bollinger
*Attorney, Agent, or Firm*—Oliff & Berridge

[57] ABSTRACT

A paper stacking apparatus including a paper stacking device for stacking plural sheets of paper thereon; a paper size detecting device for detecting a size of the paper to be stacked on the paper stacking device; a paper stack detecting device for detecting whether the paper is present or absent on the paper stacking device; and a control device for inhibiting stacking of the paper when the paper size detected by the paper size detecting device is different from a preset paper size, and for allowing the stacking when absence of the paper on the paper stacking device is detected by the paper stack detecting device during inhibition of the stacking. Accordingly, the control device inhibits paper having any sizes other than the preset paper size from being stacked on the top of stacked sheets of paper present on the paper stacking device and restores allowance of stacking when the paper present on the paper stacking device is removed during inhibition of stacking.

7 Claims, 8 Drawing Sheets

SIZE OF PAPER THAT CAN BE STACKED

SIZE OF PAPER AT THE TOP OF STACK

| | B4S | A4S | B5S | A5S | A4L | B5L |
|---|---|---|---|---|---|---|
| B4S | ○ | ○ | ○ | ○ | ○ | ○ |
| A4S | | ○ | ○ | ○ | | |
| B5S | | | ○ | ○ | | |
| A5S | | | | ○ | | |
| A4L | | | ○ | ○ | ○ | ○ |
| B5L | | | | ○ | ○ | ○ |

○:ALLOWANCE OF STACKING

PAPER STACKING APPARATUS

BACKGROUND OF THE INVENTION

1. Field of the Invention

The present invention relates to a paper stacking apparatus for stacking a large amount of recording paper output from a printer or the like for a host computer, and more particularly to such a paper stacking apparatus capable of preventing break of a paper stacked condition possibly occurring in stacking different-sized sheets of paper in a mixed condition.

2. Description of the Related Art

A high-capacity paper stacking apparatus connected with a printer or the like for a host computer is designed to stack printed sheets of paper having various sizes continuously ejected from the printer, on a paper stacking tray in order of ejection of the printed sheets.

A typical paper stacking apparatus of this kind will now be described. Each printed sheet of paper ejected from the printer is first received by a disk provided in the paper stacking apparatus and is then stacked on the paper stacking tray by rotation of the disk. The paper stacking tray is lowered according to an amount of paper stacked thereon and is controlled to be located always in a proper position allowing receipt of the paper from the disk. In such a position control of the paper stacking tray, an elevator motor for vertically moving the paper stacking tray is controlled to be driven in relation to presence or absence of paper on the paper stacking tray and rotating operation of the disk, that is, paper ejecting operation of the printer, thereby lowering the paper stacking tray by a given distance to the proper position. In this manner, every time a given amount of paper is stacked on the paper stacking tray, the lowering of the paper stacking tray by the given distance is repeated to effect stacking of a large amount of paper on the paper stacking tray.

However, in a conventional paper stacking apparatus having no paper guide as disclosed in Japanese Utility Model Laid-open No. Hei 2-69665, for example, stacking of a large amount of paper brings about break of a paper stacked condition on the paper stacking tray. For example, when a large amount of paper having a small size is first stacked and a large amount of paper having a large size is then stacked on the stack of the small-sized paper, the large-sized paper projects from the outline of the small-sized paper to cause the break of the paper stacked condition. Further, in a conventional paper stacking apparatus as shown in FIG. 10 of Japanese Patent Laid-open No. Hei 4-251070, no paper guide is provided in a paper ejecting direction, so that when a large amount of paper having a small size in the paper ejecting direction is first stacked and a large amount of paper having a large size in the paper ejecting direction is then stacked on the stack of the small-sized paper, the large-sized paper projects from the edge of the small-sized paper in the paper ejecting direction to cause the-break of the paper stacked condition. Further, in a conventional paper stacking apparatus as shown in FIG. 2 of Japanese Patent Laid-open No. Hei 1-198766, paper guides are provided in a paper ejecting direction and in a lateral direction perpendicular to the paper ejecting direction, so that there is no possibility of the break of the paper stacked condition when stacking paper having the same size as a size defined by the paper guides. However, when a large amount of paper having a small size is first stacked and a large amount of paper having a large size is then stacked on the stack of the small-sized paper, there is a possibility of the break of the paper stacked condition.

SUMMARY OF THE INVENTION

It is accordingly an object of the present invention to provide a paper stacking apparatus which can inhibit paper having any sizes other than a preset paper size from being stacked on the top of stacked sheets of paper present on a paper stacking tray and can restore allowance of stacking when the paper present on the paper stacking tray is removed during inhibition of stacking.

According to an aspect of the present invention, there is provided a paper stacking apparatus comprising paper stacking means for stacking plural sheets of paper thereon; paper size detecting means for detecting a size of the paper to be stacked on the paper stacking means; paper stack detecting means for detecting whether the paper is present or absent on the paper stacking means; and control means for inhibiting stacking of the paper when the paper size detected by the paper size detecting means is different from a preset paper size, and for allowing the stacking when absence of the paper on the paper stacking means is detected by the paper stack detecting means during inhibition of the stacking.

With this configuration, when the paper size detected by the paper size detecting means is different from the preset paper size, the control means inhibits stacking of the paper. Further, when absence of the paper on the paper stacking means is detected by the paper stack detecting means during inhibition of stacking of the paper, the control means allows stacking of the paper. In this manner, the control means controls the inhibition and allowance of stacking of the paper by using a predetermined correlation between different sizes of paper that can be stacked with each other. Accordingly, a large amount of paper can be stacked without break of a paper stacked condition on the paper stacking means.

According to another aspect of the present invention, the control means has first storing means for storing the size of a top one of the plural sheets of paper stacked on the paper stacking means as present size information and second storing means for storing the size of the paper previously stacked on the paper stacking means immediately before the paper is removed from the paper stacking means as past size information, and when absence of the paper on the paper stacking means is changed to presence of the paper in an inoperative condition of the apparatus, the past size information stored in the second storing means is copied to the present size information stored in the first storing means to decide the preset paper size of paper allowed to be stacked on the top sheet of paper present on the paper stacking means.

With this configuration, when the paper removed from the paper stacking means is returned to it by a user, the past size information is copied to the present size information. Accordingly, the size of paper that can be next stacked is decided according to the updated paper size information. As a result, even when the paper is next stacked on the stack of paper returned to the paper stacking means, break of the paper stacked condition can be prevented.

As described above, according to the present invention, the size of paper that can be stacked on a top one of sheets of paper present on the paper stacking means is decided according to the size of the top sheet of paper, thereby preventing the break of the paper stacked condition with a low-cost structure having no paper guide.

Further, in the configuration that when a paper absence condition on the paper stacking means is changed to a paper presence condition in an inoperative condition of the apparatus, the past size information is copied to the present size information to decide the size of paper that can be stacked on the paper present on the paper stacking means, the size of paper previously removed from the paper stacking means and thereafter returned to it can be specified, thereby coping with operation error by the user.

In addition, when the first and second storing means for storing paper size information are constructed of nonvolatile memories, the above effect can be reliably obtained even in case of switching of a power supply.

Other objects and features of the invention will be more fully understood from the following detailed description and appended claims when taken with the accompanying drawings.

DETAILED DESCRIPTION OF THE PREFERRED EMBODIMENTS

Figure 7:
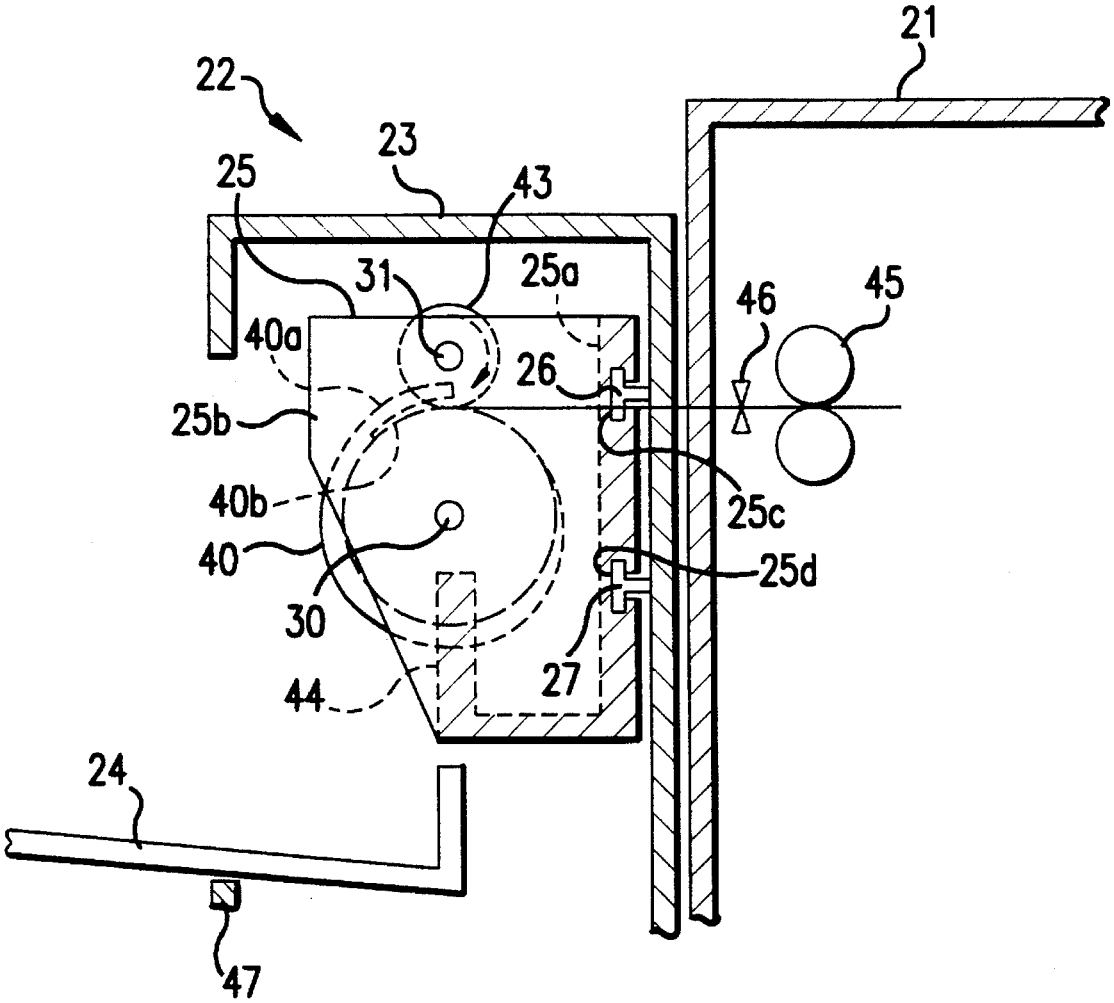
FIG. 7 is a sectional side view of a typical paper stacking apparatus to which the present invention is applicable.

Referring to FIG. 7 which shows a typical paper stacking apparatus 22 to which the present invention is applicable, the paper stacking apparatus 22 is provided at such a position as to receive plural sheets of paper continuously ejected by a paper eject roller 45 provided in a printer body 21. Reference numeral 46 denotes an optical sensor for detecting the size of the paper ejected by the paper eject roller 45. The paper stacking apparatus 22 includes a housing 23, a paper stacking tray 24, and a slidable casing 25. The slidable casing 25 has a back plate 25*a* and opposite side plates 25*b*. The back plate 25*a* has two guide grooves 25*c* and 25*d* respectively slidably engaging with two rails 26 and 27 provided on the housing 23 so that the slidable casing 25 can be slid in a lateral direction (i.e., in a direction perpendicular to a plane of the sheet of FIG. 7) according to the paper size detected by the optical sensor 46. The slidable casing 25 is provided with a nip roller 43 rotatably mounted on a rotating shaft 31, a mating roller (not shown) rotatably mounted in contact with the nip roller 43, a rotary disk 40 rotatably mounted on a rotating shaft 30 and having a finger portion 40*a*, and a paper strip plate 44. The housing 23 is vertically movable according to the weight of plural sheets of paper stacked on the paper stacking tray 24. The paper ejected by the paper eject roller 45 is nipped between the nip roller 43 and the mating roller and is fed to be inserted into a groove 40*b* formed on the finger portion 40*a* of the rotating disk 40. The rotation of the rotating disk 40 feeds the paper to the paper strip plate 44, which in turn removes the paper from the groove 40*b* of the finger portion 40*a* of the rotating disk 40 and inverts the paper to deliver it onto the paper stacking tray 24. This operation is repeated to stack plural sheets of paper on the paper stacking tray 24. Reference numeral 47 denotes an optical sensor for detecting whether the paper is present or absent on the paper stacking tray 24.

Figure 1:
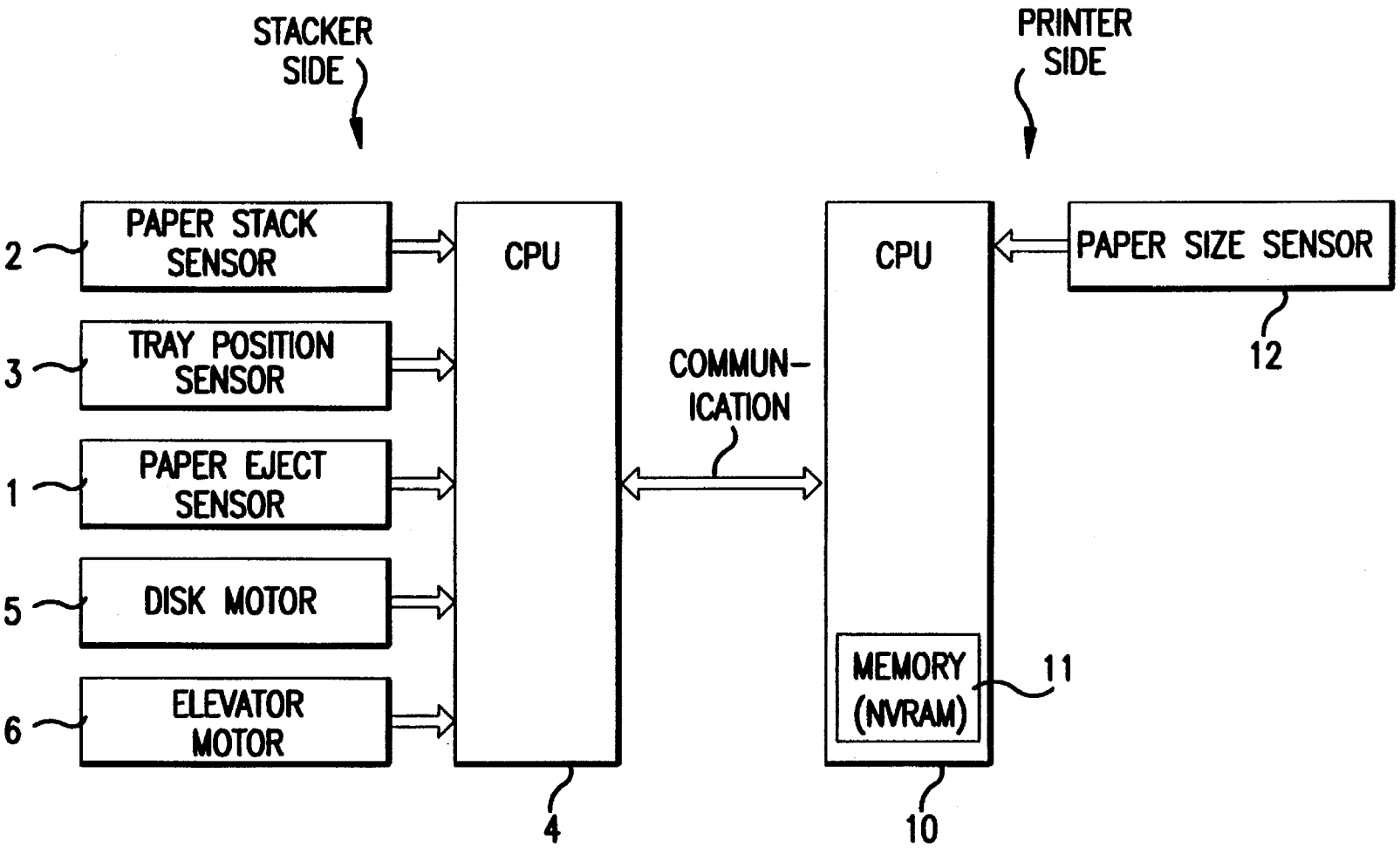
FIG. 1 is a block diagram of a control system in a preferred embodiment of the paper stacking apparatus according to the present invention.

Referring to FIG. 1 which shows a hardware structure of a control system in the paper stacking apparatus according to the present invention. A preferred embodiment of the paper stacking apparatus according to the present invention is a large-capacity paper stacker (HCS, which will be hereinafter referred to simply as a stacker) (corresponding to the element 22 shown in FIG. 7). The stacker has a control section comprising a paper eject sensor 1 for detecting a sheet of paper ejected from a printer (corresponding to the element 21 shown in FIG. 7), a paper stack sensor 2 (corresponding to the element 47 shown in FIG. 7) for detecting plural sheets of paper stacked on a paper stacking tray (corresponding to the element 24 shown in FIG. 7), a tray position sensor 3 for detecting whether or not the paper stacking tray is in a paper receivable position, and a CPU (Central. Processing Unit) 4. The CPU 4 controls a stacking operation of the stacker according to paper eject information from the paper eject sensor 1 and tray position information from the tray position sensor 3, and transmits paper stack information from the paper stack sensor 2 and disk rotation information (or stack completion information) to a CPU 10 provided in the printer.

In the stacking operation, a disk motor 5 is driven to rotate a disk (corresponding to the element 40 shown in FIG. 7) and stack the paper ejected from the printer onto the paper stacking tray. When an amount of stacked sheets of paper reaches a given amount, an elevator motor 6 is driven to lower the paper stacking tray by a given distance. Then, the stacking operation is continued. In this manner, the lowering operation of the paper stacking tray is intermittently repeated to allow a large amount of paper to be stacked on the paper stacking tray.

The CPU 10 provided in the printer controls to decide allowable sizes of paper allowed to be stacked on the paper stacking tray according to stacker information inclusive of the paper stack information and the stack completion information transmitted from the CPU 4 provided in the stacker and to inhibit the stacking of paper having any sizes other than the above allowable sizes. The CPU 10 includes a nonvolatile memory (NVRAM) 11 for storing paper size information indicative of the size of paper stacked on the paper stacking tray. Further, the printer is provided with a paper size sensor 12 (corresponding to the element 46 shown in FIG. 7) for detecting the size of paper to be fed from a paper feed tray (not shown).

The CPU 10 corresponding to the control means according to the present invention compares the paper size of the paper feed tray with the paper size of a ton one of sheets of paper stacked on the paper stacking tray when feeding the paper from the paper feed tray. Then, the CPU 10 determines whether or not the stacking of the paper is allowed according to the result of comparison and stacker information transmitted from the CPU 4 in the stacker. Then, only when the stacking is allowed, the CPU 10 commands the stacking operation to the stacker. The nonvolatile memory 11 provided in the CPU 10 comprises a nonvolatile memory (NVRAM) as the first storing means according to the present invention for storing the paper size of the top one of the sheets stacked on the paper stacking tray as present size information and a nonvolatile memory (NVRAM) as the second storing means according to the present invention for storing the size of paper that has been stacked on the paper stacking tray until it is removed from the paper stacking tray as past size information.

Figures 2, 3:
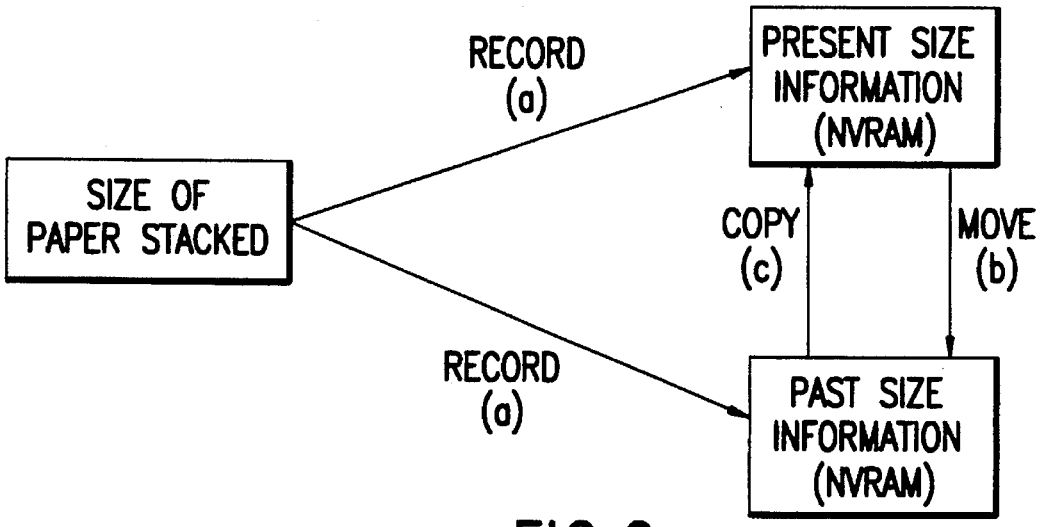
FIG. 2 is a block diagram illustrating the concept of the present invention.
FIG. 3 is an illustration of the correlation between the size of paper at the top of stack present on a paper stacking tray and the size of paper that can be stacked on the top sheet of paper present on the paper stacking tray.

There will now be described a function of preliminarily limiting the sizes of paper that can be stacked on the paper stacking tray. Referring to FIG. 2, when the presence of paper stacked on the paper stacking tray is detected by the paper stack sensor 2 during the stacking operation, the size of the paper stacked on the paper stacking tray known from the paper size information detected by the paper size sensor 12 is recorded into the present size information and the past size information stored in the memory 11 (processing (a) in FIG. 2). The present size information at this time represents the paper size of a top one of sheets stacked on the paper stacking tray.

Conversely, when the absence of paper stacked on the paper stacking tray is detected by the paper stack sensor 2 during the stacking operation, the present size information is moved to the past size information, so that the fact that no paper is now present on the paper stacking tray is stored and the size of paper previously present on the paper stacking tray is stored into the past size information for a future condition that the paper removed from the paper stacking tray may be returned to the paper stacking tray by a user (processing (b) in FIG. 2).

On the other hand, when the absence of paper is detected by the paper stack sensor 2 during an inoperative condition of the stacker, i.e., during stop of rotation of the disk, the present size information is moved to the past size information.

Conversely, when the paper absence condition on the paper stacking tray is changed to the paper presence condition, the past size information is copied to the present size information to perform processing in case that the paper removed from the paper stacking tray has now been returned to the paper stacking tray by the user (processing (c) in FIG. 2).

In this manner, the paper size of the top one of the sheets of paper stacked on the paper stacking tray is fetched and the allowable sizes of paper that can be stacked on the top sheet of paper present on the paper stacking tray are decided, thus preliminarily limiting the sizes of paper that can be stacked on the paper stacking tray to thereby prevent break of a paper stacked condition on the paper stacking tray. FIG. 3 shows an example of the correlation between various sizes of paper at the top of stack on the paper stacking tray and various sizes of paper that can be stacked on the top sheet of paper present on the paper stacking tray.

Figure 4:
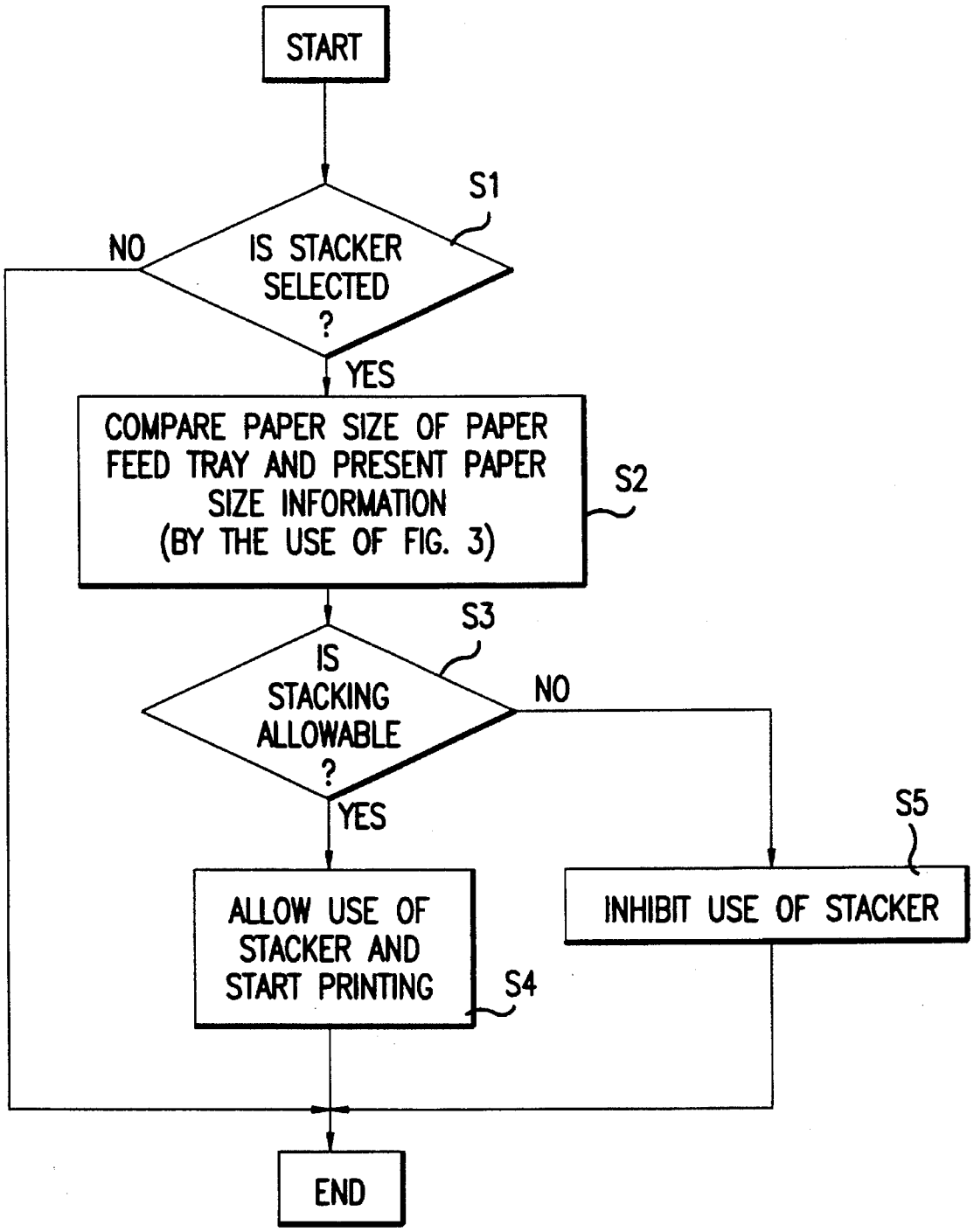
FIG. 4 is a flowchart of processing inhibition of paper stacking.

The operation of the CPU 10 in inhibiting the stacking of paper will now be described with reference to the flowchart shown in FIG. 4. When a start button (not shown) provided in the printer is pressed, the CPU 10 determines whether the stacker is selected (S1). If the stacker is selected (S1: Yes), the paper size of the paper feed tray detected by the paper size sensor 12 is compared with the present paper size information transmitted from the stacker by using the correlation shown in FIG. 3 (S2). Then, it is determined from the result of comparison whether or not the stacking of paper is allowable (S3). If the stacking is allowable (S3: Yes), the use of the stacker is allowed and a printing operation is started (S4), whereas if the stacking is not allowable, the use of the stacker is inhibited (S5). Then, the processing is ended. In step S1, if the stacker is not selected (S1: No), the processing is ended.

Figure 5:
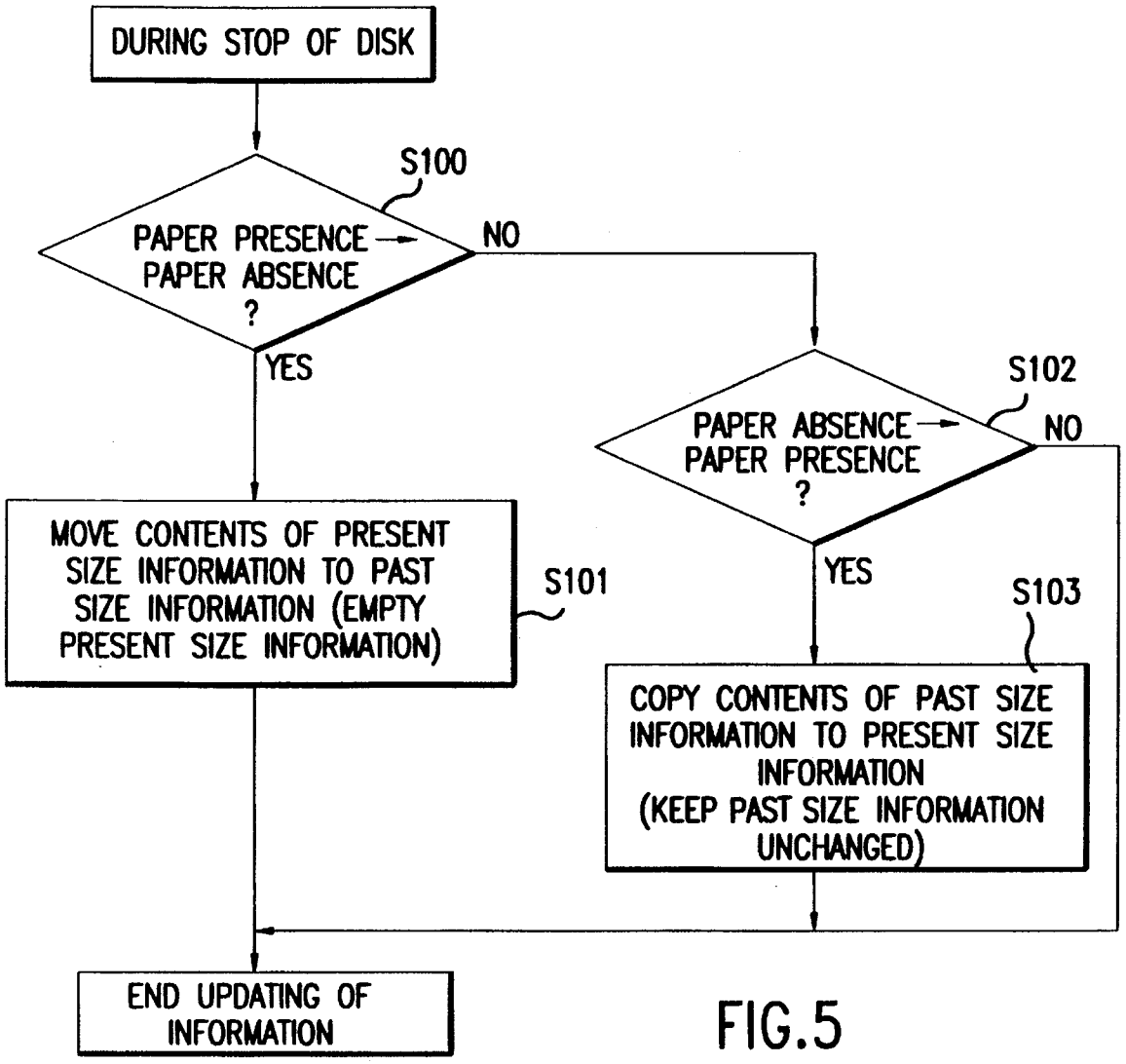
FIG. 5 is a flowchart of processing storage of a paper size during stop of a disk in the paper stacking apparatus.

Further, the operation of the CPU 10 in storing a paper size in the inoperative condition of the stacker will now be described with reference to the flowchart shown in FIG. 5. The flowchart shown in FIG. 5 illustrates the processing of storing the present paper size on the paper stacking tray according to paper stack information detected by the paper stack sensor 2. That is, the CPU 10 controls to store the size of paper stacked on the paper stacking tray in the condition where no paper is ejected, that is, the disk is not rotated, and to determine whether or not the stacking of paper to be next ejected. When communication data indicative of disk rotation end (or stack completion) is received from the stacker, the storing processing during stop of the disk is started. First, the CPU 10 determines whether or not the paper presence condition on the paper stacking tray has been changed to the paper absence condition according to a signal from the paper stack sensor 2 (S100). If the paper presence condition has been changed to the paper absence condition, that is, if the paper has been removed from the paper stacking tray by the user and no paper is now stacked on the paper stacking tray (S100: Yes), the contents of the present size information are moved to the past size information to empty the present size information (S101), thus updating the paper size information. Then, the processing is ended. The empty condition of the present size information means that no paper is now present on the paper stacking tray.

In step S100, if the paper presence condition has not been changed to the paper absence condition (S100: No), it is determined whether or not the paper absence condition has been changed to the paper presence condition (S102). If the paper absence condition has not been changed to the paper presence condition (S102: No), that is, if no change of the paper stack condition has been made, no updating of the paper size information is performed to end the processing. In step S102, if the paper absence condition has been changed to the paper presence condition (S102: Yes), that is, if the paper removed from the paper stacking tray has been returned to the paper stacking tray and the paper is now present on the paper stacking tray, the contents of the past size information is copied to the present size information with the contents of the past size information kept unchanged (S103), thus updating the paper size information. Then, the processing is ended.

Figure 6:
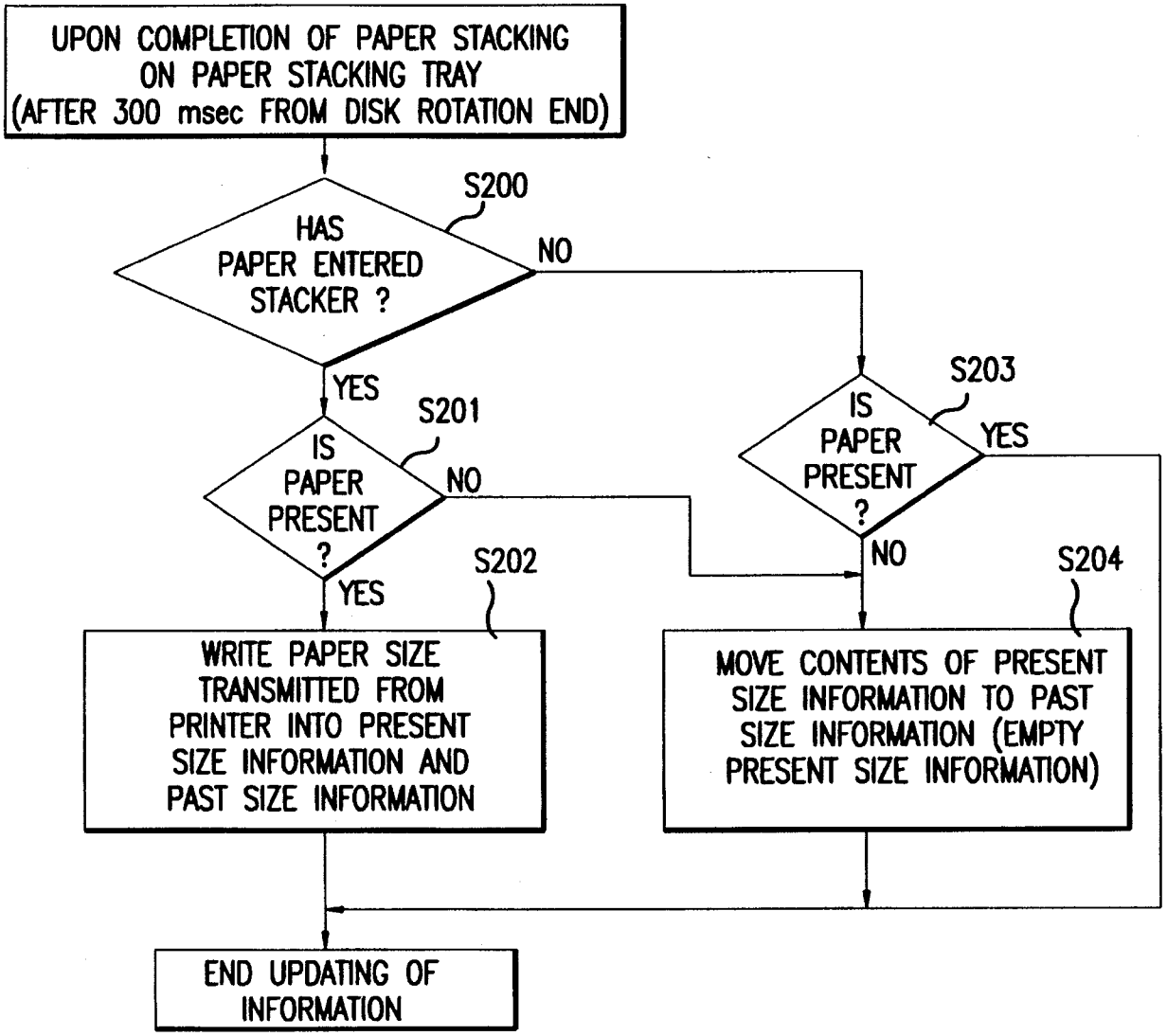
FIG. 6 is a flowchart of processing of storage of a paper size upon completion of paper stacking on the paper stacking tray.

Further, the operation of the CPU 10 in storing a paper size in an operative condition of the stacker will now be described with reference to the flowchart shown in FIG. 6. The flowchart shown in FIG. 6 illustrates the processing of storing the present paper size at the timing when the stacking of paper on the paper stacking tray has been completed (i.e., upon change in communication data: a stack completion signal is set after 300 msec from disk rotation end). First, the CPU 10 determines whether or not paper has been ejected from the printer to the stacker according to a signal from the paper eject sensor 1 transmitted as communication data from the stacker (S200). If the paper has been ejected to the stacker (S200: Yes), it is determined whether or not the paper is present on the paper stacking tray according to a signal from the paper stack sensor 2 transmitted as communication data from the stacker (S201). If the paper is present (S201: Yes), the size of the paper is written into the present size information and the past size information (S202), thus updating the paper size information. Then, the processing is ended.

In step S200, if paper has not been ejected to the stacker (S200: No), it is determined whether or not paper is present on the paper stacking tray (S203). If the paper is present (S203: Yes), the processing is ended, whereas if the paper is absent (S203: No), the contents of the present size information are moved to the past size information to empty the present size information (S204), thus updating the paper size information. Then, the processing is ended.

Also, if the paper has been ejected to the stacker (S200: Yes) and the paper is absent on the paper stacking tray (S201: No), that is, if the paper has been removed from the paper stacking tray immediately after ejected to the stacker or during rotation of the disk, the contents of the present size information are moved to the past size information to empty the present size information (S204). Then, the processing is ended.

Figure 8:
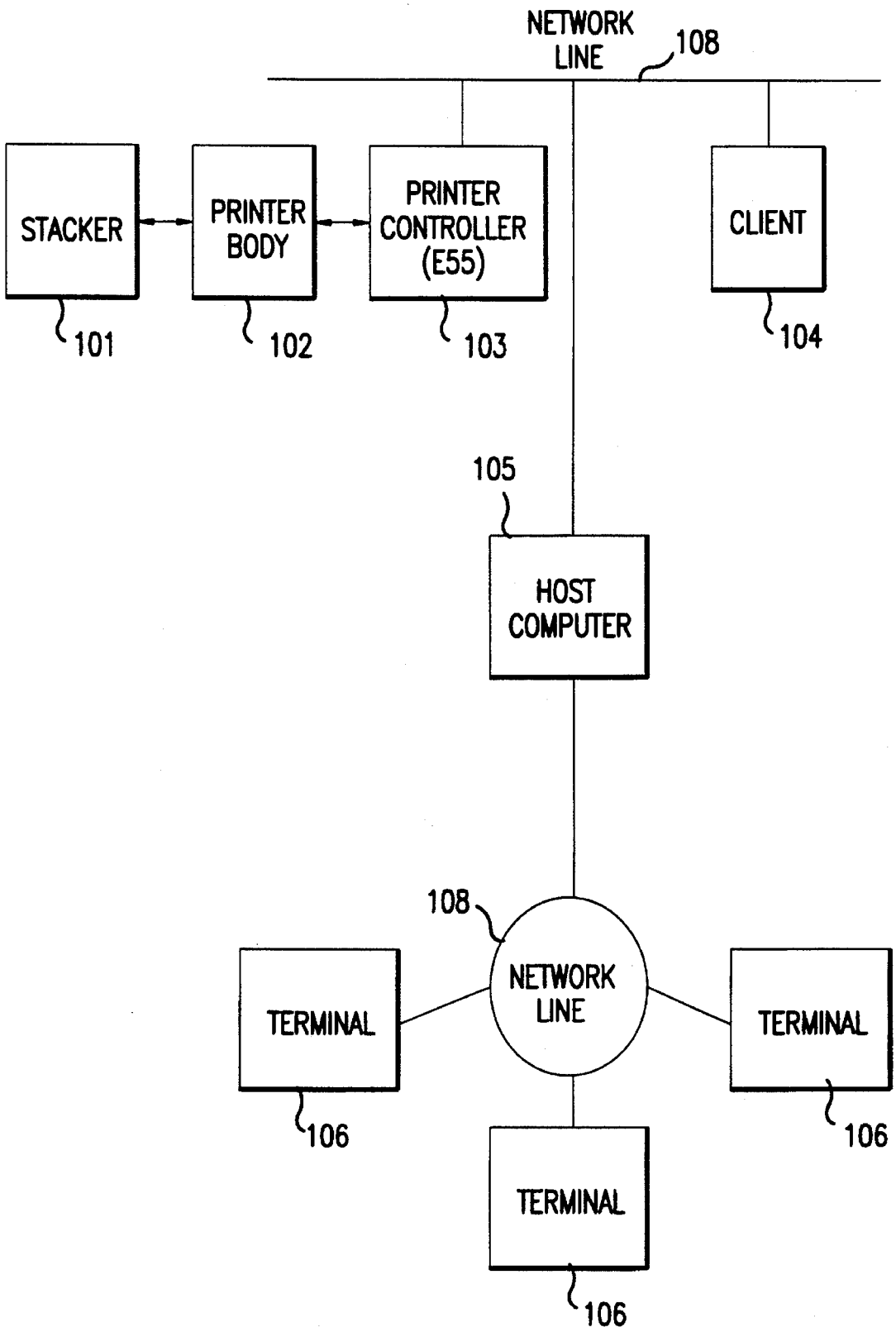
FIG. 8 is a block diagram of a network system configured so as to include the present invention.
Figure 9:
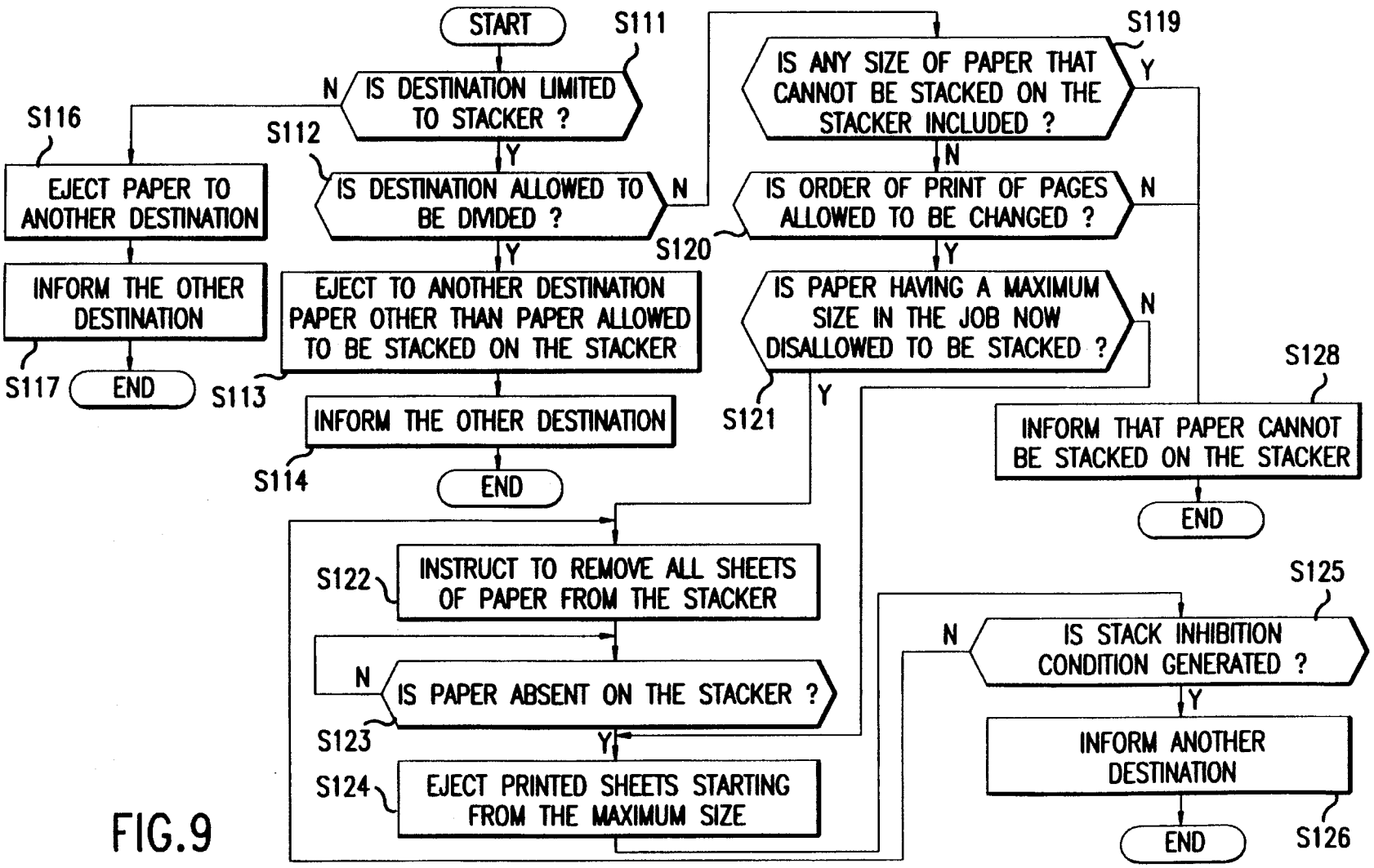
FIG. 9 is a flowchart of processing for performing a print job with different-sized sheets of paper mixed.

The control of the stacker will now be described in more detail with reference to FIGS. 8 and 9, in which FIG. 8 shows a network system configured so as to include the present invention, and FIG. 9 shows an operation of performing a print job with different-sized sheets of paper mixed.

Referring to FIG. 8, a stacker 101 is connected to a printer body 102 having a function of deciding the size of paper that can be stacked on the stacker 101 and inhibiting stacking of paper having any other sizes. A printer controller (ESS: Electronic Sub System) 103 is connected to the printer body 102 to send print control instructions to the printer body 102. The printer controller 103 is connected through a network line 108 to a client 104 and a host computer 105. The host computer 105 may be further connected through a network line 108' to plural terminals 106.

The printer controller 103 performs processing in case the stacking of paper has been inhibited by the printer body 102. Assuming that the client 104 has instructed a print job that 100 sheets of paper having an A3-size are to be printed and the destination of the paper after printed is not specified, the printer controller 103 automatically specify the destination to the stacker 101 because the number of sheets of paper to be printed is large. At this time, the printer body 102 performs stacker control as mentioned above. If the inhibition of stacking is determined, the printer controller 103 performs one of the following processings (1), (2), and (3). That is, (1) the printer controller 103 informs the client 104 of the inhibition of stacking, instructs a user to remove other printed sheets stacked on the stacker 101, and starts stacking at the time the other printed sheets are removed from the stacker 101; (2) the printer controller 103 instructs the client 104 to buffer the print job into an external storage such as a hard disk, and starts stacking at the time the other printed sheets are removed from the stacker 101; and (3) the printer controller 103 changes the destination from the stacker 101 to another paper receiving tray, and informs the host computer 105 or the client 104 that the destination has been changed. The selection of one of these processings (1) to (3) is made by the user. In other words, if the user desires to stack all the printed sheets on the stacker 101, either the processing (1) or the processing (2) is selected, whereas if the user allows the use of another destination rather than the stacker 101, the processing (3) is selected.

Referring to FIG. 9, there is shown a flowchart of processing in case the print job requires different-sized sheets of paper in a mixed condition. The print job is instructed from the client 104 by the user. As shown in FIG. 9, the printer controller 103 determines whether or not any size of paper that cannot be stacked on the stacker 101 is included (S119). If the size of paper that cannot be stacked on the stacker 101 is included, the printer controller 103 informs the client 104 that the paper cannot be stacked on the stacker 101 (S128). If all the sheets of paper can be stacked on the stacker 101, the printer controller 103 determined whether or not the order of print of pages is allowed to be changed (S120). If the order of print of pages is not allowed to be changed, the printer controller 103 informs the client 104 that the paper cannot be stacked on the stacker 101 (S128). If the order of print of pages is allowed to be changed, the printer controller 103 determined whether or not the paper having a maximum size in the print job can be stacked on the stacker 101 by the stacker control mentioned above (S121). If the paper having the maximum size can be stacked, the printer controller 103 controls the printer body 102 to eject the printed sheets starting from the maximum size (S124). If the paper having the maximum size cannot be stacked, the printer controller 103 informs the user of this situation and instructs the user to remove all sheets of paper stacked on the stacker 101 (S122), and when all sheets of paper are removed from the stacker 101 (S123: Yes), the printer controller 103 controls the printer body 102 to eject the printed sheets starting from the maximum size (S124). If the stack inhibition condition is generated during the print job (S125: Yes), the printer controller 103 changes the destination and informs the client 104 of a new destination (S126).

Prior to the above control, the printer controller 103 determines whether or not the destination of the printed sheets is limited to the stacker 101 (S111) and whether or not the destination is allowed to be divided (S112) according to instructions of the user. If the destination is limited to the stacker 101 and it is not allowed to be divided, the above control for the print job using different-sized sheets of paper in the mixed condition is carried out. If the destination is allowed to be divided, any sheets of paper other than the paper that can be stacked on the stacker 101 are ejected to another destination (S113), and the client 104 is informed of this destination (S114). On the other hand, if the destination is not limited to the stacker 101, the printed sheets are ejected to another destination (S116), and the client 104 is informed of this destination (S117).

In performing the print job using different-sized sheets of paper in the mixed condition as mentioned above, whether or not the order of print of pages is allowed to be changed is determined according to an instruction of the user. If the change of the order of print is allowable, the printed sheets are stacked starting from the maximum size, whereas if the change of the order of print is not allowable, the change is not carried out.

While the invention has been described with reference to specific embodiments, the description is illustrative and is not to be construed as limiting the scope of the invention. Various modifications and changes may occur to those skilled in the art without departing from the spirit and scope of the invention as defined by the appended claims.

What is claimed is:

1. A paper stacking apparatus comprising:

paper stacking means for stacking plural sheets of paper thereon;

paper size detecting means for detecting a size of said paper to be stacked on said paper stacking means;

paper stack detecting means for detecting whether said paper is present or absent on said paper stacking means; and control means for inhibiting stacking of said paper when said paper size detected by said paper size detecting means is different from a preset paper size, and for allowing the stacking when absence of said paper on said paper stacking means is detected by said paper stack detecting means during inhibition of the stacking.

2. A paper stacking apparatus according to claim 1, wherein said control means has first storing means for storing the size of a top one of said plural sheets of paper stacked on said paper stacking means as present size information and second storing means for storing the size of said paper previously stacked on said paper stacking means immediately before said paper is removed from said paper stacking means as past size information, and when absence of said paper on said paper stacking means is changed to presence of said paper in an inoperative condition of said apparatus, said past size information stored in said second storing means is copied to said present size information stored in said first storing means to decide the preset paper size of paper allowed to be stacked on said top sheet of paper present on said paper stacking means.

3. A paper stacking apparatus according to claim 2, wherein said first storing means and said second storing means comprise nonvolatile memories.

4. A paper stacking apparatus according to claim 1, wherein said control means has first storing means for storing the size of a top one of said plural sheets of paper stacked on said paper stacking means as present size information and second storing means for storing the size of said paper previously stacked on said paper stacking means immediately before said paper is removed from said paper stacking means as past size information, and when presence of said paper on said paper stacking means is changed to absence of said paper in an inoperative condition of said apparatus, said present size information stored in said first storing means is moved to said past size information stored in said second storing means to empty said present size information.

5. A paper stacking apparatus according to claim 1, further comprising paper eject detecting means for detecting whether paper is ejected from a printer to said apparatus, wherein said control means has first storing means for storing the size of a top one of said plural sheets of paper stacked on said paper stacking means as present size information and second storing means for storing the size of said paper previously stacked on said paper stacking means immediately before said paper is removed from said paper stacking means as past size information, and when ejection of said paper from said printer to said apparatus is detected by said paper eject detecting means and thereafter presence of said paper on said paper stacking means is detected by said paper stack detecting means, the size of said paper ejected is written into said present size information and said past size information, whereas when the ejection of said paper is detected by said paper eject detecting means and thereafter absence of said paper on said paper stacking means is detected by said paper stack detecting means, said present size information stored in said first storing means is moved to said past size information stored in said second storing means to empty said present size information.

6. A paper stacking apparatus comprising:

paper stacking means for stacking plural sheets of paper thereon;

paper size detecting means for detecting a size of said paper to be stacked on said paper stacking means;

stack inhibiting means for specifying a size of paper to be inhibited from being stacked on said paper stacked on said paper stacking means according to size information output from said paper size detecting means and inhibiting stacking of said paper having the size specified above;

paper stack detecting means provided on said paper stacking means for detecting whether said paper is present or absent on said paper stacking means; and stack allowing means for allowing the stacking of said paper having said specified size inhibited from being stacked when absence of said paper on said paper stacking means is detected by said paper stack detecting means.

7. A paper stacking apparatus according to claim 6, wherein said stack inhibiting means has first and second storing means for storing said size information output from said paper size detecting means; said size information stored in said first storing means is moved to said second storing means every time said paper is stacked on said paper stacking means; said size information stored in said second storing means is copied to said first storing means when absence of said paper on said paper stacking means is detected by said paper stack detecting means and thereafter presence of said paper is detected by said paper stack detecting means; and the size of said paper to be inhibited from being stacked is specified according to said size information stored in said first storing means.

* * * * *